US009309091B2

(12) United States Patent
Husmann

(10) Patent No.: US 9,309,091 B2
(45) Date of Patent: Apr. 12, 2016

(54) ELEVATOR INSTALLATION WITH CAR AND COUNTERWEIGHT

(75) Inventor: Josef Husmann, Lucerne (CH)

(73) Assignee: Inventio AG, Hergiswil (CH)

( * ) Notice: Subject to any disclaimer, the term of this patent is extended or adjusted under 35 U.S.C. 154(b) by 481 days.

(21) Appl. No.: 13/989,960

(22) PCT Filed: Dec. 9, 2011

(86) PCT No.: PCT/EP2011/072278

§ 371 (c)(1),
(2), (4) Date: May 28, 2013

(87) PCT Pub. No.: WO2012/080106

PCT Pub. Date: Jun. 21, 2012

(65) Prior Publication Data

US 2013/0248296 A1 Sep. 26, 2013

(30) Foreign Application Priority Data

Dec. 17, 2010 (EP) ..... 10195785

(51) Int. Cl.

| | |
|---|---|
| ***B66B 1/32*** | (2006.01) |
| ***B66B 5/02*** | (2006.01) |
| ***B66B 5/12*** | (2006.01) |
| ***B66B 5/18*** | (2006.01) |
| ***B66B 5/22*** | (2006.01) |

(52) U.S. Cl.

CPC ... *B66B 5/02* (2013.01); *B66B 5/12* (2013.01); *B66B 5/125* (2013.01); *B66B 5/18* (2013.01); *B66B 5/22* (2013.01)

(58) Field of Classification Search

CPC ..... B66B 5/02; B66B 5/12; B66B 5/18; B66B 5/22; B66B 5/125

USPC ..... 187/247, 286, 287, 288, 289, 305, 371, 187/372, 391, 393, 412, 413

See application file for complete search history.

(56) References Cited

U.S. PATENT DOCUMENTS

| | | | | |
|---|---|---|---|---|
| 2,490,653 A | | 12/1949 | Sahlin | |
| 2,493,553 A | | 1/1950 | Sahlin | |
| 3,601,227 A | * | 8/1971 | Burch | B66B 5/20 187/288 |
| 4,467,895 A | * | 8/1984 | Smith | B66B 1/3476 187/391 |
| 6,173,813 B1 | | 1/2001 | Rebillard et al. | |
| 7,527,127 B2 | * | 5/2009 | Osterman | B66B 5/0031 187/288 |

(Continued)

FOREIGN PATENT DOCUMENTS

EP 0593154 A1 10/1992

OTHER PUBLICATIONS

The American Society of Mechanical Engineers, ASME A17.1-2007/CSA B44-07 Safety Code for Elevators and Escalators, Apr. 6, 2007, pp. 225 and 320, Canadian Standards Association, Canada.

(Continued)

*Primary Examiner* — Anthony Salata

(74) *Attorney, Agent, or Firm* — Fraser Clemens Martin & Miller LLC; William J. Clemens

(57) ABSTRACT

An elevator installation includes a car, a counterweight and safeties which are fitted to the car and the counterweight. The car contains an electrically controlled device for actuating and optionally resetting the safety and the counterweight also contains an electrically controlled device with a safety, or the safety of the counterweight is actuated by a slack-line release.

12 Claims, 10 Drawing Sheets

(56) References Cited

U.S. PATENT DOCUMENTS

| | | | | |
|---|---|---|---|---|
| 7,575,099 | B2 | 8/2009 | Bacellar | |
| 7,730,998 | B2 * | 6/2010 | Takahashi | B66B 1/32 187/287 |
| 7,926,622 | B2 * | 4/2011 | Henneau | B66B 5/00 187/393 |
| 7,938,231 | B2 * | 5/2011 | Ueda | B66B 5/02 187/288 |
| 8,167,094 | B2 * | 5/2012 | Ueda | B66B 1/32 187/288 |
| 8,365,872 | B2 * | 2/2013 | Ueda | B66B 5/04 187/288 |
| 8,602,170 | B2 * | 12/2013 | Fischer | B66B 11/043 187/288 |
| 8,602,173 | B2 * | 12/2013 | Berner | B66B 5/125 187/250 |
| 8,752,677 | B2 * | 6/2014 | Harkonen | B66B 1/34 187/288 |
| 2007/0131489 | A1 | 6/2007 | Stalder | |
| 2008/0017456 | A1 | 1/2008 | Ito | |
| 2012/0006627 | A1 * | 1/2012 | Carparelli | B66B 5/12 187/266 |
| 2013/0153340 | A1 * | 6/2013 | Dold | B66B 5/0018 187/393 |

OTHER PUBLICATIONS

Gigasense AB, Overload Guard (LKV), Oct. 23, 2014. Web Site pp. 1-2, Gigasense AB, Sweden.

Gigasense AB, LKV—Overload Guard, Aug. 12, 2010, Web Pages, Retrieved from http://web archive.org, Sweden.

* cited by examiner

Fig. 1
2 elevator car
3 counterweight
5 drive
11 safety brake device
11g safety brake device
14, 14g equipment
44, 44g energy store
45 charging apparatus
45g charging apparatus
46, 46g brake control
48 hanging cable
49 compensating cable
50 drive control
51 tachometer
52 brake devices
57 speed sensor system
57g speed sensor system
59, 59g voltage converter
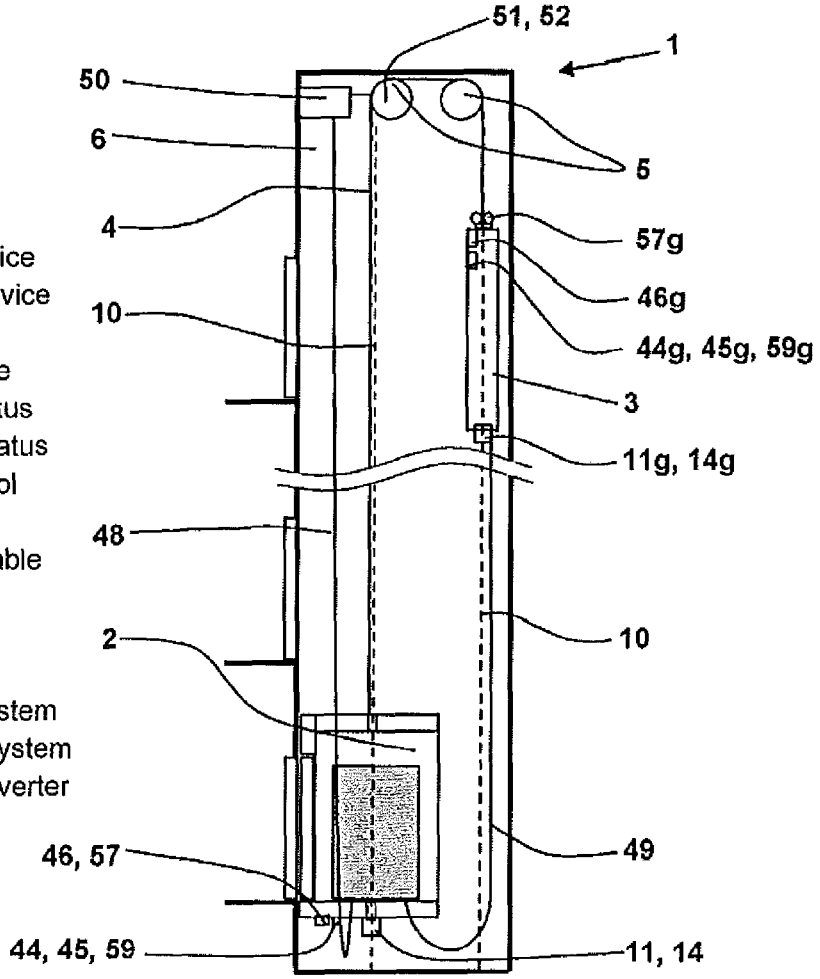
2 elevator car
3 counterweight
11a, 11b, 11g
safety brake device
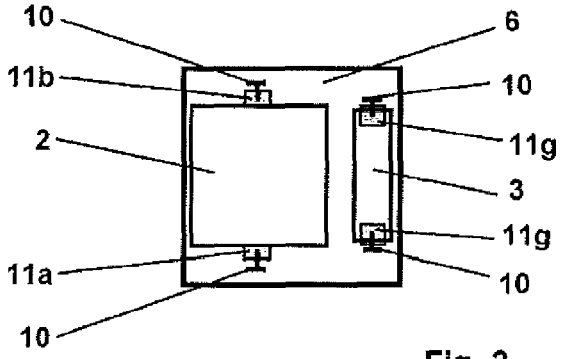
Fig. 2

2 elevator car 3 counterweight 11 safety brake device
14 equipment 42 safety circuit 43 energy module
46 brake control 54 control circuit electromagnet
55 control circuit resetting equipment 57 speed sensor system
58 guide shoes 62 safety equipment 2 elevator car 3 counterweight
11a, 11b, 11g safety brake device 14a, 14b, 14g equipment
43, 43g energy module 44, 44g energy store
45, 45g charging apparatus 46, 46g brake control
50 drive control 51 tachometer 52 brake devices
57, 57g speed sensor system 59, 59g voltage converter
62, 62g safety equipment

ELEVATOR INSTALLATION WITH CAR AND COUNTERWEIGHT

FIELD

The invention relates to an elevator installation with car and counterweight and with safety brake devices which are attached to the car and the counterweight.

BACKGROUND

Elevator installations are incorporated in a building. They essentially consist of an elevator car connected by way of support cables or support belts with a counterweight. The car as well as the counterweight are moved along substantially vertical guide rails by means of a drive, which selectably acts on the support means, directly on the car or the counterweight. The elevator installation is used for conveying persons and goods within the building over individual or several floors.

The elevator installation includes devices in order to safeguard the elevator car in the case of failure of the drive or the support means or to protect against undesired drifting away or dropping down even in the case of a stop at a floor. For that purpose, use is usually made of safety brake devices which can in case of need brake the elevator car on the guide rails.

Until now, safety brake devices of that kind were activated by mechanical speed limiters. However, currently, increasing use is also made of electronic monitoring devices which can activate braking or safety brake devices when needed.

In order to nevertheless be able to have resort to known and proven safety brake devices, electromechanical actuating devices are required which in the case of appropriate control can actuate safety brake devices.

A device of that kind is known from EP 0543154. In that case, an auxiliary double-jaw brake is when required brought into engagement with a guide rail and this auxiliary double-jaw brake actuates an existing lever system, whereby safety brake devices are actuated. This auxiliary double-jaw brake is designed to be able to move the lever system and mass parts of the safety brake device. The requisite electromagnetic units have to be of correspondingly large size.

A further device of that kind is known from U.S. Pat. No. 7,575,099. In this solution, safety brake wedges of a safety brake device are directly actuated by springs when required. The springs are biased by an electromagnet and the biased springs are released when required. The springs can, if need be, be reset again by a spindle drive or stressed. This electromagnet also has to be of an appropriately large size, since the total biasing force of several springs has to be directly accepted and maintained.

Brake or safety brake devices are also often present at the counterweight in elevator installations. This is particularly the case when areas which can be walked on are present below the elevator shaft or when, for example, brake devices are needed at the counterweight in order to prevent uncontrolled upward movement.

SUMMARY

The invention thus provides at least an alternative solution for actuation and if need be also for resetting a safety brake device in an elevator installation by means of electrical control and integration thereof in the elevator installation. In particular, solutions for equipping the counterweight with brake or safety brake devices shall be demonstrated, wherein in that case also the use of a mechanical limiter at the counterweight shall be dispensed with.

This solution or these solutions shall preferably be able to be combined with conventional safety brake devices.

Further aspects such as rapid actuation of the safety brake device, low energy consumption, simple mounting and behavior of the device in the case of energy failure or component faults shall be taken into consideration to the extent possible.

An elevator installation serves for the transport of goods and person in buildings. The elevator installation for that purpose includes at least one elevator car for receiving the persons and goods, and usually a counterweight. The counterweight and elevator car are connected together by way of support means such as, for example, a support cable, a support belt or other forms of support means. These support means are guided over a deflecting roller or a drive pulley and the counterweight and the elevator car thus move in opposite sense in the building or in an elevator shaft provided in the building. In order to prevent falling down of the car and, in particular, also the counterweight or also in order to prevent other faulty behavior of these travel bodies—by travel body there is understood in the following not only the elevator car, but also the counterweight—at least the elevator car and also the counterweight are equipped with a safety brake device. The travel bodies in that case usually respectively include two safety brake devices, which are each associated with a respective guide rail. The guide rails—usually two guide rails—guide the travel bodies along the elevator shaft and they include a web on which the safety brake device can engage for the purpose of braking. One form of embodiment of a conventional safety brake device includes two safety brake wedges. The safety brake wedges are mounted and guided in the safety brake device to be vertically displaceable. In normal operation of the elevator installation the safety brake wedges are disposed in a lower readiness position. When required, the safety brake wedges are pushed upwardly along an inclined guide track by equipment for actuation of the safety brake device until they clamp the web of the guide rail. The friction force arising due to the clamping now moves—in the case of safety brake device or travel bodies continuing to move—the safety brake wedges further into a housing of the safety brake device until wedge abutment occurs. Due to this further movement the housing, which is of appropriate resilient construction, is pressed against by the wedge action of the safety brake wedges. This pressing against ultimately determines a pressing force of the safety brake wedges against the web of the guide rail and thus a braking force which brakes the travel bodies.

In one embodiment the equipment for actuating and optionally also resetting the safety brake device includes an individual pressure store which when required moves the two safety brake wedges of the brake device explained in the foregoing, substantially synchronously, from the readiness position as far as the web of the guide rail into a safety brake position. In addition, the equipment preferably includes a remotely actuable resetting device which can again stress the pressure store in a readiness position. This takes place when the travel body, after braking and checking of the safety state of the elevator installation have been carried out, is to be released again.

The common pressure store enables safe actuation of the safety brake device, since both wedges can be actuated simultaneously and free of jamming. The common pressure store can also be coupled in simple manner to safety brake devices, for example by way of a lever system.

Obviously, other forms of safety brake devices, such as, for example, a roller blocking safety brake device, can also be correspondingly actuated, wherein in the case of safety brake devices of that kind safety brake rollers or appropriate other safety brake elements are actuated instead of safety brake wedges.

One embodiment of equipment of that kind for actuation and also for resetting the safety brake device is disclosed in an application of the same Applicant, which was filed with the file reference EP 10195781.9 on the same priority date. The content of this application also counts as part of this application and is included herein by reference.

Another solution for controlling or actuating a safety brake device is disclosed in another application of the same Applicant, which was filed with the reference EP 10195791.8 on the same priority date. The content of this application similarly also counts as part of this application and is included herein by reference. In this solution use is made of an entrainer body which can be controlled by means of an electromagnet. The entrainer body is pressed against the guide rail when required and it can thereby actuate a safety brake device coupled with the entrainer body. This construction is particularly suitable for safety brake devices which are able to brake in both directions of travel, since the entrainer body can actuate the safety brake device as a consequence of a relative movement between guide rail and safety brake device.

The equipment for actuating and optionally also for resetting a safety brake device is preferably installed in a housing or the housing is a component of the device. This housing is so shaped and provided with connecting plates that the device can be attached to a safety brake device or that it can be attached together with the safety brake device to the car or the counterweight. As already mentioned in the introduction current safety brake devices are usually actuated by means of a lever mechanism, which is actuated by a limiter cable. These safety brake devices usually include a lower connecting point which enables fastening of guide shoes. The present, shaped housing is now advantageously so designed that it can be attached at this connecting point. The connecting plate is, for example, screw-connected between guide shoe and safety brake device or it is screw-connected between travel body and safety brake device. The equipment for actuating and optionally also resetting the safety brake device can thus be attached to an existing lift elevator installation or an existing safety brake device. It is thus particularly suitable for modernization of elevator installations.

The equipment for actuation the safety brake device can be used together with a corresponding safety brake device in different configurations in elevator installations.

In one configuration variant a pair of safety brake devices with associated items of equipment for actuation of the safety brake devices is arranged on the car. The items of equipment for actuation of the safety brake devices are activated by an electronic limiter and possible resetting equipment is controlled by brake control apparatus. The electronic limiter, for example, controls directly, or by way of the corresponding brake control apparatus, the electromagnets of the items of equipment for actuating and possibly also for resetting the safety brake devices. The electromagnets are preferably connected in series.

The electronic limiter can be, for example, a speed monitoring device such as used in WO03004397 or it can be a monitoring device which evaluates a rotational speed of rollers, which roll on the car along the guide rails, or it can be a safety supervisory system as presented in EP 1602610. The electronic limiter or the equipment associated therewith is advantageously equipped with electronic energy stores, such as batteries, accumulators or condenser batteries. In the case of energy failure in the building the safety device is kept active over a predefined time with the help of this energy store.

Obviously, several pairs of safety brake devices each with associated equipment for actuation of the safety brake device can be attached to the car instead of one pair of safety brake devices.

In one configuration variant the counterweight is equipped with one pair or several pairs of safety brake devices with associated equipment for actuating and optionally also for resetting the safety brake devices. This is often required particularly in the case of elevator installations with large transport heights or in the case of elevator installations in which further areas such as, for example, cellars or garages are located below the elevator. Electronic limiters, as are illustrated in the case of the car, are also possible with these counterweights.

However, in a modified configuration variant the counterweight does not have an individual speed limiter, but the counterweight is controlled by a safety system, which is at the car, by way of signal lines which are, for example, integrated in a compensating cable.

In a further configuration variant the counterweight has an individual electronic limiter. The electronic limiter in that case includes, for example, rollers which are arranged on the counterweight and there roll along the guide rails of the counterweight or the electronic limiter is installed in a support roller of the counterweight or driven by it. For preference, at least two rollers are equipped with rotational speed pick-ups. The speed of the counterweight is determined by way of the two rotational speed pick-ups and if an excessive speed is detected the equipment for actuating the safety brake device is actuated so that the counterweight is stopped.

The counterweight can in that case be supplied with energy by way of the compensating cable and status signals can be communicated by way of a communications bus. The communications bus can be realized by way of a power line connection or by way of an individual data line.

Energy supply of a counterweight can obviously also take place by way of batteries, which, for example, are supplied with power by a generator—which can be integrated in the rollers—or which are filled in a night charging cycle. Recharging can, for example, take place at stopping points where energy can be transmitted by way of a contact bridge such as a wiper contact or by way of induction coils, etc. A possible resetting command can, for example, be communicated in wire-free manner (wirelessly). Equally, a status signal of the safety brake device or of the equipment for actuating the safety brake device can also be communicated in wire-free manner.

In another configuration variant the counterweight is equipped with a safety brake device which is actuated, merely in the case of an absent suspension force, by means of slack-cable monitoring means. This slack-cable monitoring means connects the support means with the counterweight. The slack-cable monitoring means includes, for example, a spring mechanism which triggers in the case of absence of a tension force in the support means and actuates the safety brake device. With slack-cable monitoring means of that kind or also slack-cable triggering means the safety brake device at the counterweight is actuated merely in the case of loss of the suspension force at the counterweight, which is the case, for example, in the event of failure of a support means. In order to prevent an erroneous response, for example as a consequence of cable oscillations, the slack-cable monitoring means is provided with a delay device or a damping device, such as a pneumatic damper or response delay means. A response delay means is, for example, a path which is to be traversed by slack-cable triggering means before a safety brake device is brought into action. Paths of approximately 50 to 150 millimeters are enough to sufficiently delay slack-cable triggering means in elevator installations with a travel speed of up to 1.6 m/s. A damping device, for example an oil damper, is advantageously designed in order to delay response of the safety brake device by up to 0.5 seconds. For greater travel speeds, the response delay or a delay time of the damping device is to be correspondingly increased, wherein the design values are advantageously determined by test arrangements.

An advantage of this variant is that electrical coupling of the counterweight with the elevator installation is not required and the counterweight is, nevertheless, effectively safeguarded against crashing down. A possible erroneous triggering of the safety brake device at the counterweight can be monitored at the car or at the drive, since in the case of response of this safety brake device a sudden strong change in load at the drive or in the support means results.

In another configuration variant of an elevator installation the safety brake device or the equipment for actuating the safety brake device is additionally controlled by a detection device for detecting an undesired departure of the elevator car from standstill. In a particularly simple construction of a detection device of that kind a co-running wheel is, when required, pressed against a guide track of the elevator car. In normal operation the co-running wheel is spaced from the guide track, i.e. it is not driven. The detection device includes a sensor which detects rotation of the co-running wheel, when at standstill it is pressed against the guide track, through a predetermined rotational angle and which in the case of exceeding the predetermined rotational angle interrupts the control circuit to the electromagnet of the equipment for actuating the safety brake device. The safety brake device is thereby actuated and further slipping away of the elevator car is prevented.

Combinations of the configuration variants shown for the counterweight and the car are obviously possible. In particular, use can be made on, for example, the elevator car of a brake device or safety brake device such as used in European Patent Application EP 10195791.8 filed on the same priority date. This brake device or safety brake device is, in one embodiment, a brake device which acts on both sides and which includes, for example, an eccentric safety brake device. This is advantageous if merely one safety brake device actuated in the case of a slack cable is used at the counterweight. The brake device, which acts on both sides, of the elevator car can safeguard the elevator car from all uncontrolled movements and the safety brake device, which is actuated in the case of a slack cable, of the counterweight is merely for safeguarding against dropping down of the counterweight, for example, as a consequence of breakage of the supporting and drive means. This fault can be detected by the slack-cable monitoring means. In addition, a brake device such as known for Application EP 10156865 can be attached in an ideal manner to the elevator car and used.

DESCRIPTION OF THE DRAWINGS

The invention is explained by way of example in the following on the basis of a preferred embodiment in conjunction with the figures, in which:

FIG. 1 shows a schematic view of an elevator installation,

FIG. 2 shows a schematic plan view of the elevator installation of FIG. 1.

DETAILED DESCRIPTION

Figure 3:
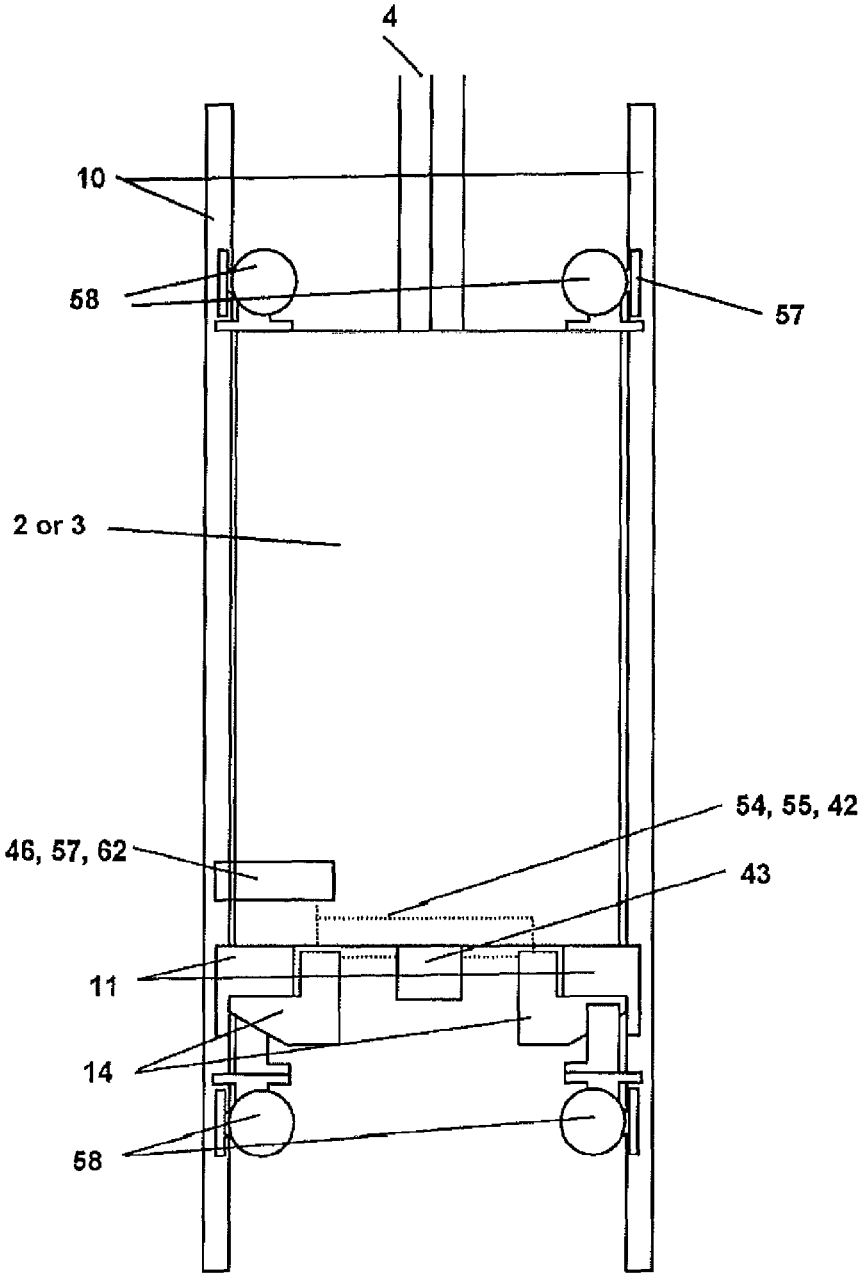
FIG. 3 shows an elevator car in installed state in the elevator installations.

The same reference numerals are used in the figures for equivalent parts over all figures.

FIG. 1 together with FIG. 2 shows a schematic elevator installation 1 in an overall view. The elevator installation 1 is installed in a building or in an elevator shaft 6 of the building and serves for transport of persons or goods within the building. The elevator installation 1 includes an elevator car 2, which can move upwardly and downwardly along guide rails 10. The elevator car 2 is accessible from the building by way of doors. A drive 5 serves for driving and holding the elevator car 2. The drive 5 is arranged in the upper region of the elevator shaft 6 and the car 2 is connected by support device or means 4, for example support cables or support belts, with the drive 6. The support means 4 are guided over the drive 5 onwards to a counterweight 3. The counterweight balances a mass component of the elevator car 2 so that the drive 5 for the main part merely has to compensate for an imbalance between the car 2 and counterweight 3. In the example the drive 5 is arranged in the upper region of the elevator shaft 6. It could obviously also be arranged at another location in the building or in the region of the car 2 or the counterweight 3. The drive 5 usually includes a tachometer 51 which measures the actual rotational speed of the drive motor and communicates it to an elevator and drive control 50. The elevator and drive control 50 regulates and monitors the elevator operation; it controls the drive 5 and actuates possible brake devices 52 of the drive unit 5. The elevator and drive control 50 is usually connected by way of a communications bus with other control devices of the elevator installation. The elevator and drive control 50 is usually connected with the car 2 by a hanging cable 48. The car is supplied with energy by way of this hanging cable 48 and the hanging cable 48 also includes the requisite communications lines.

The elevator and drive control 50 can obviously also be constructed to have a single housing. Different functional groups of the elevator and drive control 50 can, however, also be arranged in individual housings at different locations in the elevator installation.

The elevator car 2 is equipped with a safety brake device 11 or, in the example, with a pair of safety brake devices 11*a*, 11*b*, which is suitable to secure and/or decelerate the elevator car 2 in the case of an unexpected movement, in the case of excess speed or at a stop. The safety brake device 11, 11*a*, 11*b* is, in the example, arranged below the car 2.

The safety brake device 11 or each of the safety brake devices 11*a*, 11*b* is connected with respective equipment 14, 14*a*, 14*b* for actuating the safety brake device. The items of equipment 14, 14*a*, 14*b* for actuating the safety brake device are connected with a brake control 46, which can control the equipment 14, 14*a*, 14*b* for actuation of the safety brake device for the purpose of actuating the safety brake device 11, 11*a*, 11*b* and optionally also for resetting the equipment 14, 14*a*, 14*b*. The brake control 46 includes an electronic limiter or a corresponding speed sensor system 57 or is connected with such. A mechanical speed limiter, such as is usually used, can accordingly be eliminated. The electronic limiter or the corresponding speed sensor system 57 is constructed as already described in the general part and is not explained in more detail here. The electronic limiter or the corresponding speed sensor system 57 can obviously be arranged directly on the car 2 or signals from the elevator control 50 can also be used.

The equipment 14, 14*a*, 14*b* for actuating the safety brake device and brake control 46 are, in the illustrated example, connected with an energy store 44 with associated charging apparatus 45 and voltage converter 59.

Figure 4:
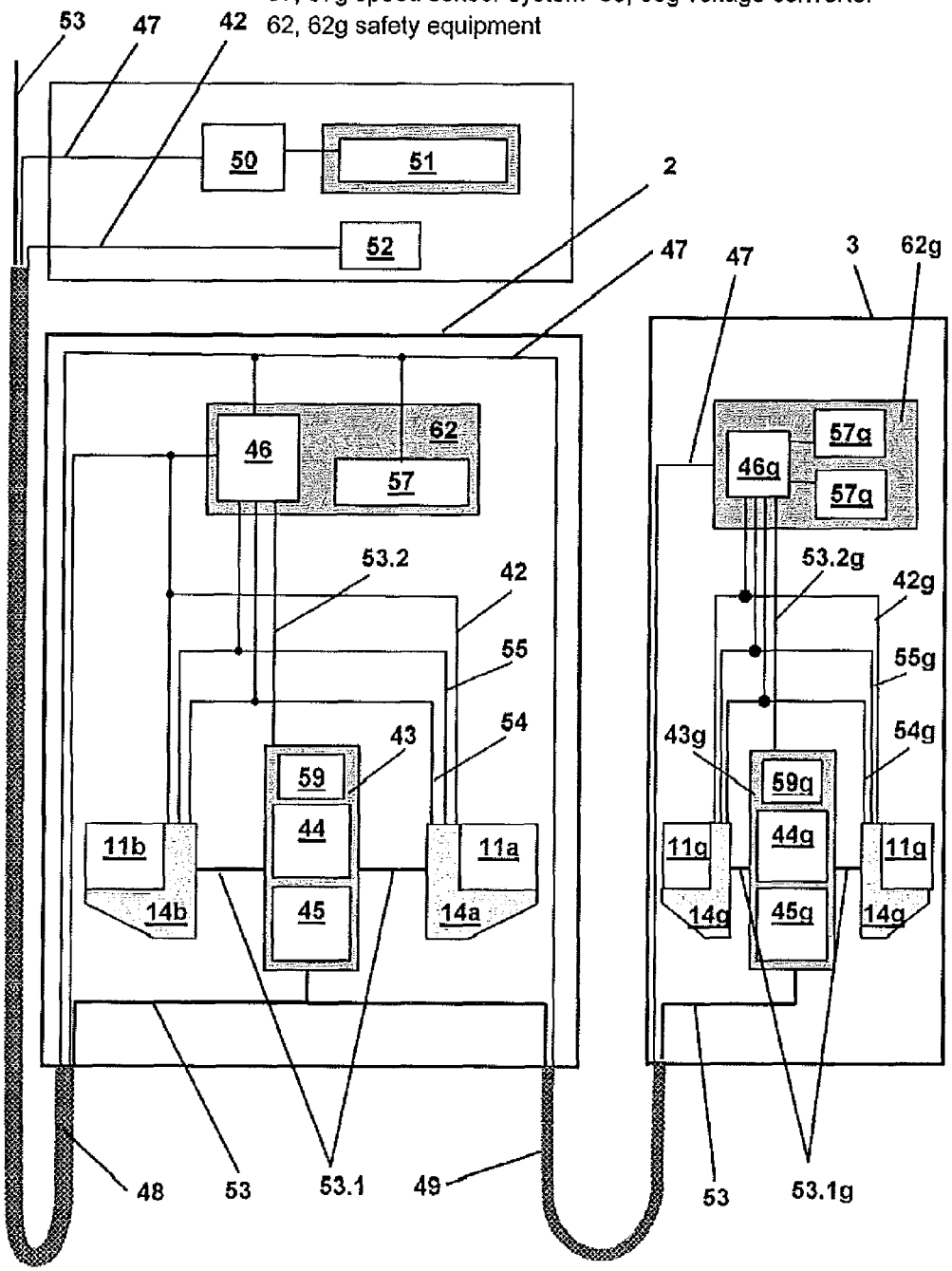
FIG. 4 shows a schematic illustration of one possible electrical interconnection of the safety brake devices of an elevator installation.

Details of this embodiment are described in conjunction with FIG. 4.

In the illustrated example according to FIGS. 1 and 2 the counterweight 3 is also equipped with safety brake devices 11*g*. These are in turn suitable for securing and/or decelerating the counterweight 3 in the case of unexpected movement or in the case of excess speed. The safety brake device 11*g* is, in the example, similarly arranged below the counterweight 3. The counterweight is connected with the car 3 by means of a compensating cable 49. Compensating cables 49 are used, particularly in the case of larger buildings, in order to compensate for a weight of the support means 4 which displaces during the movement of the car 2 and counterweight 3 relative to one another. In the present example this compensating cable 49 includes electrical lines which on the one hand supply the counterweight 3, or a brake control 46*g* arranged there, an energy store 44*g* as well as an associated charging apparatus 45*g* with voltage converter 59*g*, with energy and requisite electrical signals.

The arrangement and functioning of the safety brake device 11*g*, the equipment 14*g* for actuating the safety brake device and associated parts substantially correspond with the embodiment illustrated in the case of the car 2. The safety brake device 11*g* at the counterweight 3 obviously also usually includes at least one pair of safety brake devices 11*g* with associated equipment far actuation of the respective safety brake devices.

In the illustrated example, in particular, the counterweight 3 has an individual electronic limiter or a corresponding speed sensor system 57*g*. This sensor system substantially consists in that a rotational speed of rollers, for example guide rollers, is recorded. No further safety-relevant data are needed in this arrangement. Consequently, the compensating cable 49 does not have to transmit any safety-relevant data.

A travel body or an elevator car 2 or, analogously, a counterweight 3 with an attached safety brake device 11 and associated equipment 14 for actuation and, in the example, also for resetting the safety brake device 14 is illustrated in FIG. 3. The elevator car 2 or elevator counterweight 3 is suspended at a support means 4 and is guided along guide rails 10 by means of guide shoes 58.

Triggering of the safety brake device is initialized by an electronic speed limiter eGB 57 by way of a brake control 46.

In one embodiment a respective rotational speed sensor 57 is integrated in at least two rollers. The rollers rotate along the guide rails 10 in correspondence with a travel speed of the travel body. An evaluating unit (not illustrated) compares the signals of the two rotational speed sensors 57 with one another and detects the actual travel speed. On detection of non-agreement between the signals an alarm is triggered and the installation is stopped. If one signal or both signals of the two rotational speed sensors 57 shows or show an excessive travel speed the control circuit of the two items of equipment 14 for actuation of the safety brake device is interrupted and the safety brake devices 11 are actuated.

Other embodiments of the electronic speed limiter eGB 57 are possible such as described in the general part. The speed limiter eGB 57 can be arranged on the car or the counterweight or in the engine room or it is arranged in redundant form at several locations.

An energy module 43 advantageously makes available the energy at the same time for the brake control, if need be the speed measurement and the possible operation of the resetting equipment. It is usually supplied with energy by way of a hanging cable or a compensating cable.

FIG. 4 shows an exemplifying arrangement and electric circuit of the safety brake device in an elevator installation. The elevator and drive control 50 is arranged in the shaft 6, advantageously in the vicinity of the drive. The elevator and drive control 50 includes a safety circuit 42. This safety circuit 42 is interrupted when the elevator installation is in a safety-relevant state which is not compatible with normal travel. Such a state is present, for example, when an access door to the car is not correctly closed or when an emergency switch is actuated, etc. In the case of interruption of the safety circuit 42, drive of the elevator installation is usually stopped and a drive brake 52 is actuated. The elevator and drive control 50 usually also has available information with regard to the travel speed of the drive, which is usually communicated by a drive rotational speed transmitter 51 to the elevator and drive control 50. The elevator and drive control 50 is preferably further connected by means of a communications bus 47 with the rest of the elevator system and obviously the elevator installation has an electrical energy supply mains 53.

Various further electrical components, which are connected by way of the hanging cable 48, for example by way of the communications bus 47, but also the safety circuit 42, with the elevator and drive control 50 are located on the car 2. These components are, apart from further operationally necessary parts such as door control, lighting, etc., the brake control 46, usually an electronic speed limiter 57, an energy module 43 and the equipment 14 (14*a*, 14*b*) for actuation of the safety brake device.

The equipment 14 for actuation of the safety brake device is attached to the respective safety brake device 11 (11*a*, 11*b*) and can actuate this when required and if need be, depending on the respective form of embodiment, reset this. The equipment 14 for actuating the safety brake device is controlled by the brake control 46, for example by way of a control circuit electromagnet 54, in order to actuate the safety brake device 11 and in order to also reset this, for example by way of control circuit resetting equipment 55. The equipment 14 for actuating the safety brake device is preferably incorporated in the safety circuit 42. This has the effect that when the equipment 14 for actuating the safety brake device is triggered the safety circuit 42 is necessarily opened and the drive of the elevator installation stopped. The energy module 43 supplies the safety equipment 62 together with the associated brake control 46 and preferably also the equipment 14 for actuating the safety brake device with energy. In the illustrated example the optional resetting equipment 14 of the safety brake device is supplied with a voltage of 12 V direct current through lines 53.1 and the brake control 46 with a voltage of 24 V direct current through line 53.2. The energy module 43 for that purpose has an energy store 44 which, in the example, is connected by way of a charging apparatus 45 with the energy mains 53 and is charged by this. In order to generate different voltages, a voltage converter 59 is provided in the example. As a result, proprietary products, for example from vehicle construction, can be used, for example, as resetting equipment, since 12 V components are available there very favorably.

In the example according to FIG. 4 the counterweight 3 is similarly equipped with safety brake devices 11*g*. Components associated with the counterweight 3 that correspond with components associated with the car 2 are identified with the same reference numerals with a "g" added. The safety brake devices 11*g* are in turn provided with equipment 14*g* for actuation of the safety brake devices and the counterweight has an individual safety device 62*g* with associated brake control 46*g* and energy module 43*g*, which are of substantially the same construction as explained for the example of the car 2. The energy mains 53 and the communications bus 47 are led to the counterweight 3 by way of a compensating cable 49. The safety circuit 42 in this embodiment is not led to the counterweight 3, but the safety reports of the safety brake device 11*g* and the equipment 14*g* for actuation of this safety brake device are processed in the brake control 46*g* and communicated to the elevator control 50 by way of the communications cable 47. Moreover, in this embodiment the counterweight 3 has a first and a second speed sensor 57*g* which measure a travel speed of the counterweight. The speed sensors are preferably installed in rollers at the counterweight. The two speed sensors 57*g* can be monitored for agreement and a reliable speed signal can be generated therefrom. On the basis of this reliable speed sensor the brake control can, on detection of an excessive speed of the counterweight, actuate the safety brake devices 11*g*.

Alternative embodiments and combinations are possible. Instead of the energy mains on the counterweight a co-running roller-generator can charge the energy store of the counterweight 44*g* and instead of the wire-bound communications bus a wireless communications bus can be used. It could thus be possible to dispense with the compensating cable 49.

Figure 5:
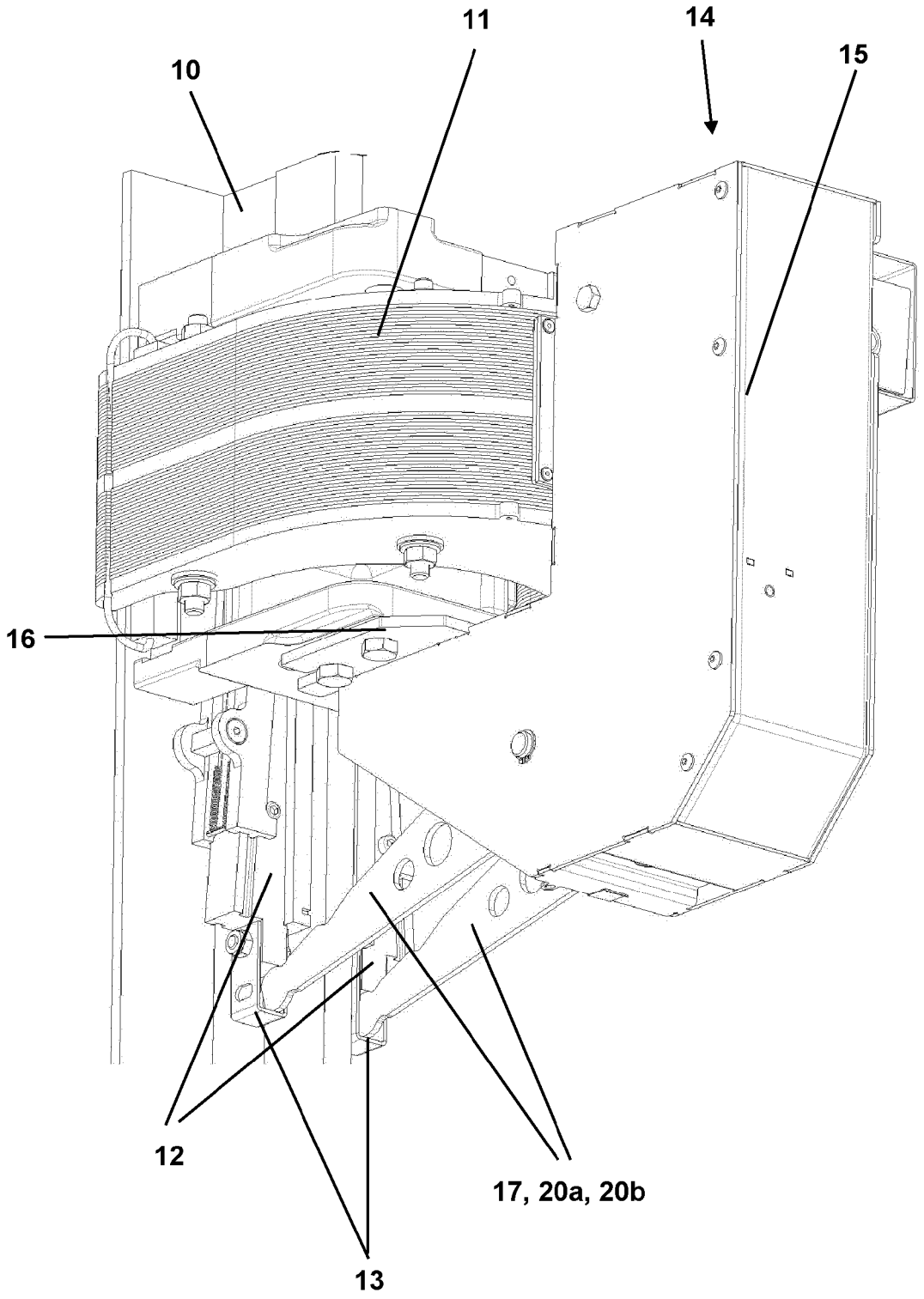
FIG. 5 shows an individual safety brake device with attached equipment for actuation and resetting of the safety brake device.

FIG. 5 now shows the safety brake device 11 with attached equipment 14 for actuating and resetting the safety brake device. The safety brake device 11 is, in the example, a single-acting sliding safety brake device. Safety brake wedges 12 are, when required, urged by the equipment 14 for actuating and resetting the safety brake device by way of an actuator 17 by means of lever arms 20*a*, 20*b* upwardly into a safety braking position or until they bear against the guide rail 10. The movement of the mass, or the car 2 or the counterweight 3, to be braked and the friction between safety brake wedge 12 and rail 10 then ensures building up of a normal force and braking force. In order to reset the safety brake device the mass to be braked initially has to be moved upwardly so that the safety brake wedges 12 are released from their clamping position. Then, if the friction force between safety brake wedge and rail is sufficiently small, the safety brake wedge 12 can be reset by the lever arms 20*a*, 20*b* via connecting straps 13 downwardly into a readiness position. The equipment 14 for actuating and resetting the safety brake device is screw-connected with the safety brake device 11 by means of a connecting plate 16.

In the example, the safety brake device is actuated from below. Alternatively, the actuation can also take place from above in that the equipment for actuating and resetting the safety brake device draws up the safety brake wedges from above for actuation and then urges the safety brake wedges downwardly again for resetting. In the example, the safety brake device is again employed in such a manner that it brakes an upward movement of the travel body or the car or the counterweight. The equipment could, together with the safety brake device, also be used conversely in that the equipment for actuating and resetting the safety brake device holds safety brake wedges in an upper operating position and moves them downwardly when required in order to brake unintended travel in upwardly direction.

A safety brake device 11 with safety brake wedges are shown in the example. The proposed equipment for actuating and resetting the safety brake device can itself obviously also co-operate with a roller safety brake device, wherein safety brake rollers are actuated instead of safety brake wedges. In addition, use of eccentric safety brake devices is possible, in which case the eccentric is then rotated by means of an actuating rod by the equipment for actuating and resetting the safety brake device.

A construction and functional sequence of equipment for actuating and resetting the safety brake device is explained in the following FIGS. 6 to 9 in connection with the safety brake device illustrated in FIG. 5.

Figure 6:
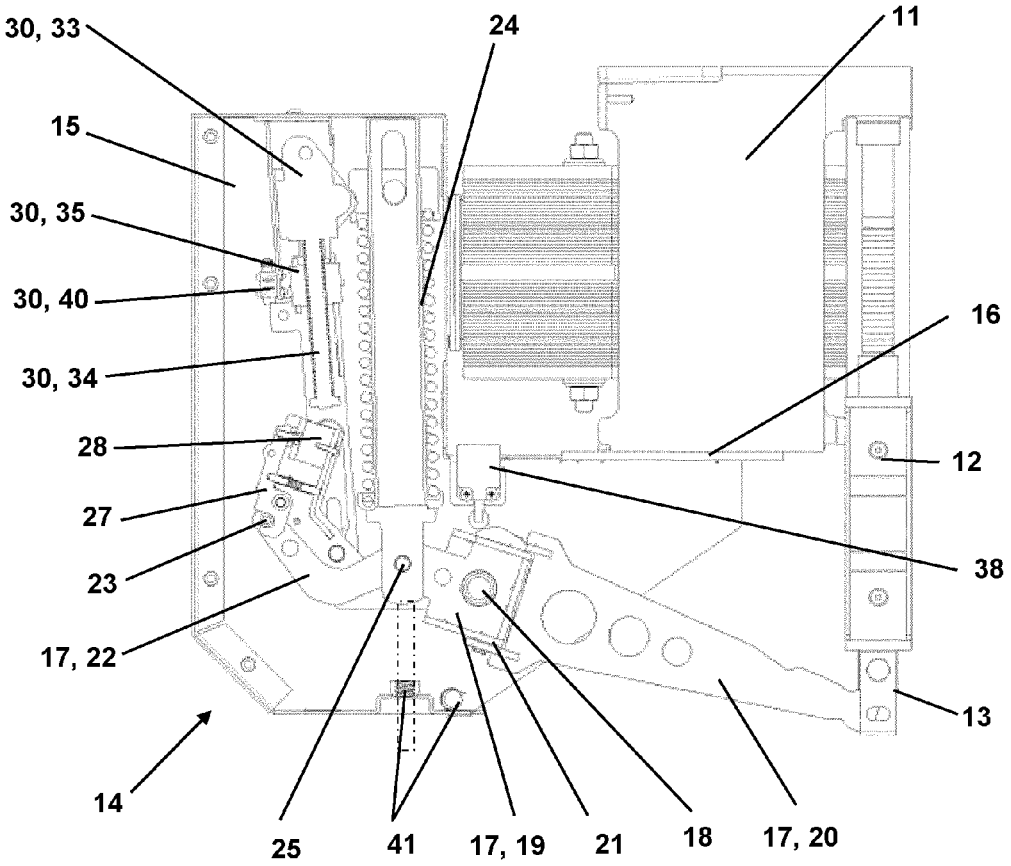
FIG. 6 shows the equipment with the safety brake device in readiness position.

FIG. 6 shows the electrically actuable safety brake device 11 together with the equipment 14 for actuating and resetting the safety brake device in readiness setting or in a normal setting, such as corresponds with normal operation of the elevator installation. The equipment 14 for actuating and resetting the safety brake device is attached, preferably screw-connected, to the safety brake device 11 by means of a connecting plate 16. The safety brake wedges 12 are, in the illustrated normal setting, entirely at the bottom and have, horizontally, several millimeters spacing from the guide rail, so that they cannot wipe against the same during movement of the travel body (not illustrated). The safety brake wedges 12 are firmly held by the actuator 17, or by the lever arm 20 integrated in the actuator 17 or the lever arms 20*a*, 20*b* (see FIG. 5) integrated in the actuator 17, by means of the connecting strap or straps 13. The actuator 17 is mounted in the housing 15 to be pivotable about a pivot axle 18 and it additionally comprises a control arm 22 which co-operates with an electromagnet 28 by way of a retaining lug 23 and retaining pawl 27. A pressure store 24, constructed in the example as a compression spring, similarly engages the control arm 22 or actuator 17 by way of a press axle 25 and provides a requisite actuating force in order to actuate the safety brake device when required, i.e. on release of the retaining lug 23.

In addition, the lever arm 20 is preferably installed in the actuator 17 by way of a vertical joint 21. This joint makes possible lateral compensation when the safety brake wedge 12 displaces laterally when pushing up along a wedge chamfer. Instead of the joint 21 the lever arm 20 can itself obviously also be appropriately resiliently constructed or the connecting strap 13 can be so constructed that a lateral displacement is made possible.

In the views according to FIGS. 6 to 9 merely one lever arm 20 is visible each time. However, it is clear in connection with FIG. 5 that in each instance two lever arms 20*a*, 20*b*, which actuate the associated safety brake wedges, are arranged adjacent to one another. The lever arms 20*a*, 20*b* are then preferably assembled by way of a central pivot body 19 to form the actuator 17.

In the example, the actuator 17 is constructed from various individual parts such as pivot body 19, lever arms 20, 20*a*, 20*b* and control arm 22. The actuator can obviously also be constructed integrally, for example as a cast part.

In the example, a lever spacing between connecting strap 13 and pivot axle 18 is selected to be large by comparison with the control spacing between press axle 25 and pivot axle 18. This lever ratio is approximately 5:1. Engagement travels at the pressure store and control arm are thereby small. This is advantageous, since a rapid actuation of the safety brake device can thereby be achieved. In one embodiment a required stroke of the safety brake wedges 12 is approximately 100 millimeters until clamping of the safety brake wedges at the guide rail takes place. Due to the 5:1 translation the stroke at the press axle is merely approximately 20 millimeters. The mass of the two safety brake wedges, which in the example is approximately 2×1.5 kilograms, can be moved within less than 0.1 seconds into the safety braking position by a pressure store force of approximately 1,000 Newtons to 1,400 Newtons. This rapid reaction time can be optimized by measures at the actuator which reduce the mass of the actuator, such as apertured lever or lever material of aluminum or other light and yet strong materials.

The force design of the pressure store is in that case so selected that, for example, sufficient residual force for actuation of the safety brake device still exists even in the case of breakage of a compression spring, which is equivalent to force loss of one spring coil.

The electromagnet 28 is operated according to the static current principle. This means that a retaining force is present as long as current flows. In this state, the electromagnet 28 thus fixes the retaining pawl 27, which in turn fixes the control arm 22 and thus the pressure store 24 by way of the retaining lug 23. The actuator 17 is thus fixed and the retaining brake wedges 12 are firmly held by way of the levers 20 and the connecting strap 13. As a result, erroneous actuation of the safety brake wedges, for example by erroneous wiping of the contact rail, is also prevented.

Moreover, the setting of the actuator 17 is monitored by a first position sensor 38.

In one embodiment the equipment 14 for actuating and resetting the safety brake device is, as further apparent in FIG. 6, provided with an assembly lock 41. The assembly lock 41 can, for simple mounting, be inserted into the housing as illustrated in FIG. 6 by means of dot-dashed outline and then holds the actuator, preferably mechanically, in the readiness setting. The equipment can thereby be simply moved into and mounted in the connecting straps. This is helpful, since during mounting of the safety brake device or the equipment for actuating and resetting the safety brake device electrical parts are usually still not wired. In an advantageous embodiment this assembly lock is coupled with the position sensor 38 in order to prevent the elevator installation from being placed in operation with inserted assembly lock. After mounting of the equipment or after electrical wiring and controlling of the equipment 14 for actuating and resetting the safety brake device has been carried out the assembly lock 41 can be removed and, for example, stored in the housing by a retaining clip, and the equipment 14 for actuating and resetting the safety brake device is then, as explained in the foregoing, held by the electromagnet 28 in the readiness setting.

If the current flow in the electromagnet 28 is now interrupted, for example by the brake control 46 (see FIGS. 1 to 4) or another safety device, then the magnet force thereof prevails. The retaining pawl 27 releases, as apparent in FIG. 7, the retaining lug 25 of the control arm 22 or the actuator 17 and the actuating force of the pressure store 24 now urges the safety brake wedges 12 upwardly into the safety braking position. The travel body, or the elevator car or the counterweight, is constrainedly braked. The first position sensor 38 is actuated simultaneously with the actuation of the safety brake wedges 12, whereby the safety circuit 42 of the elevator installation (see FIG. 4) is interrupted. Advantageously, a second position sensor 39, for example a microswitch, which monitors the setting of the retaining pawl 27 itself, is arranged at the electromagnet 28. This second position sensor 39 can be used in order to recognize, in good time, erroneous opening of the retaining pawl 27 or also in order to control resetting of the equipment 14 for actuating and resetting the safety brake device as explained in the following.

Figure 7:
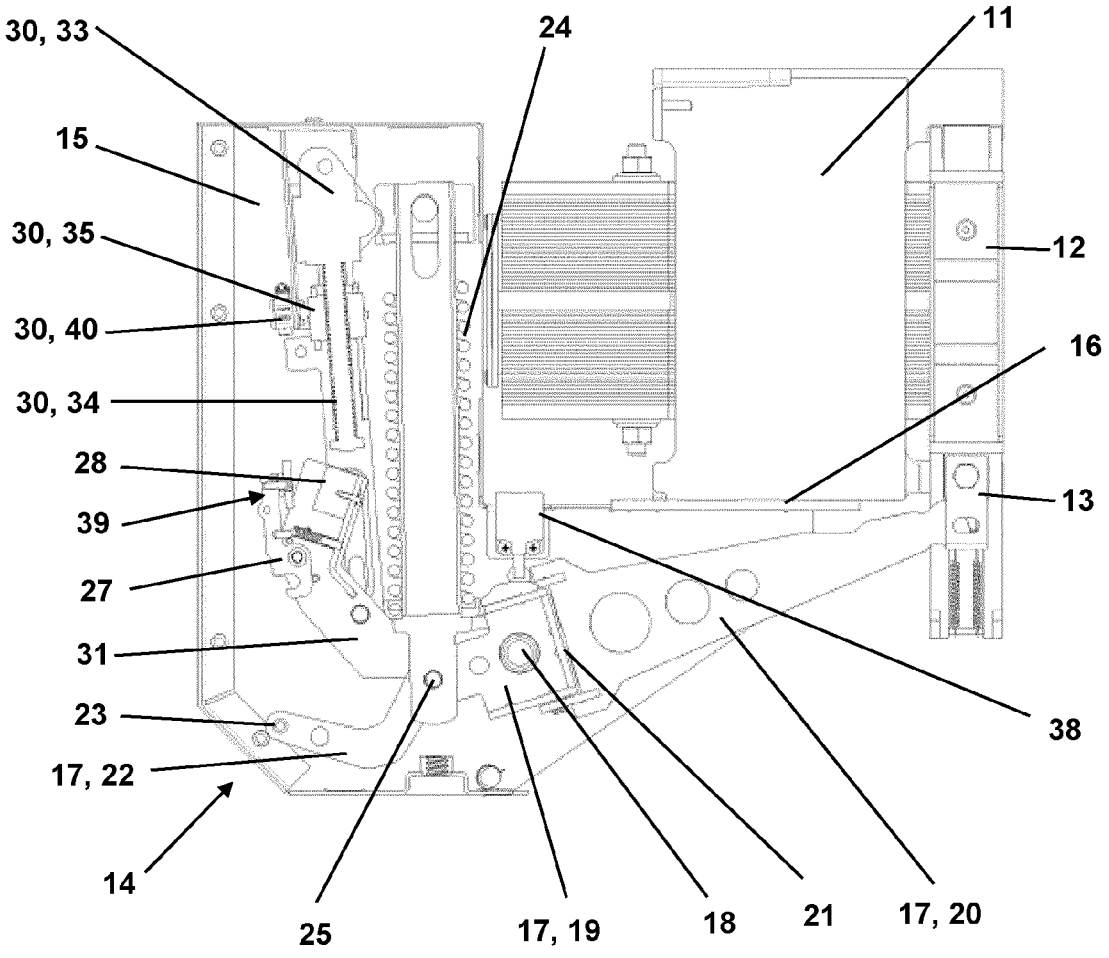
FIG. 7 shows the equipment with the safety brake device in engaged setting.
Figure 8:
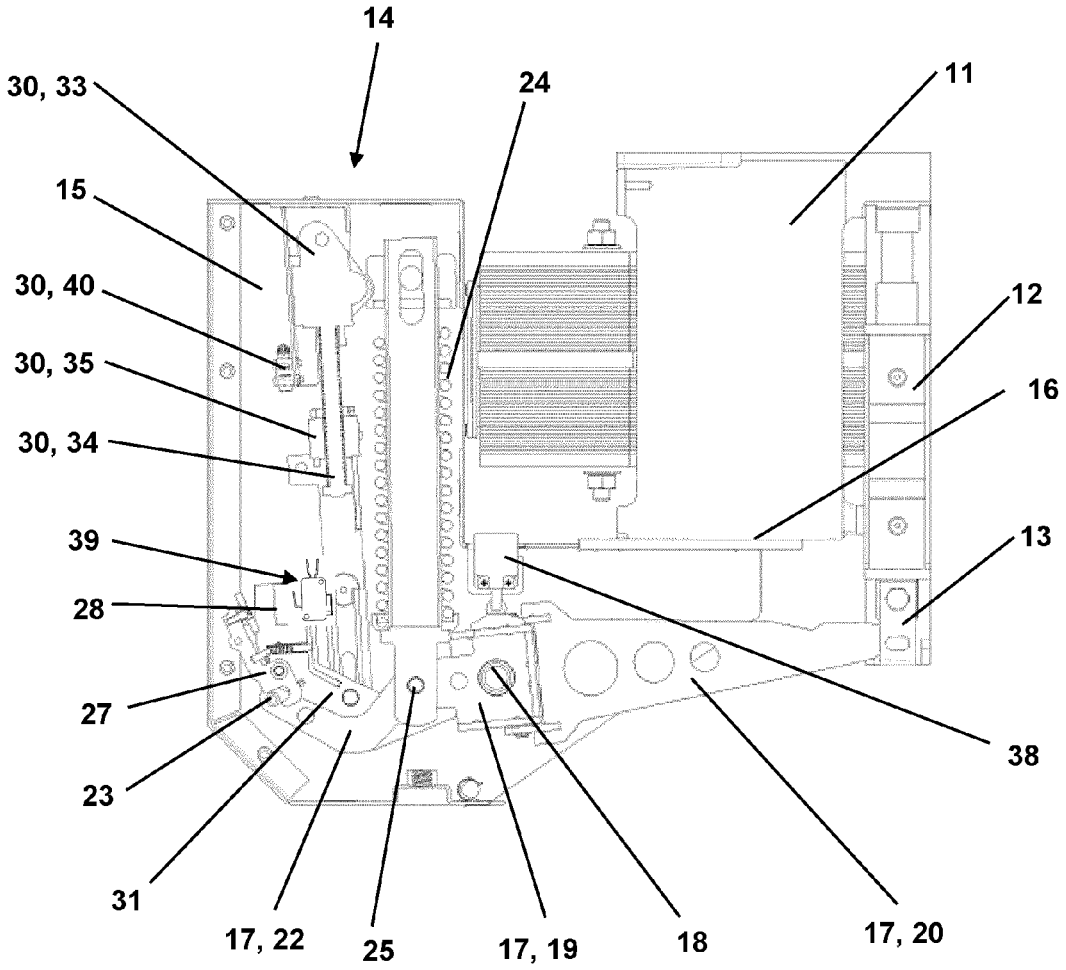
FIG. 8 shows the equipment with the safety brake device in reset position.
Figure 9:
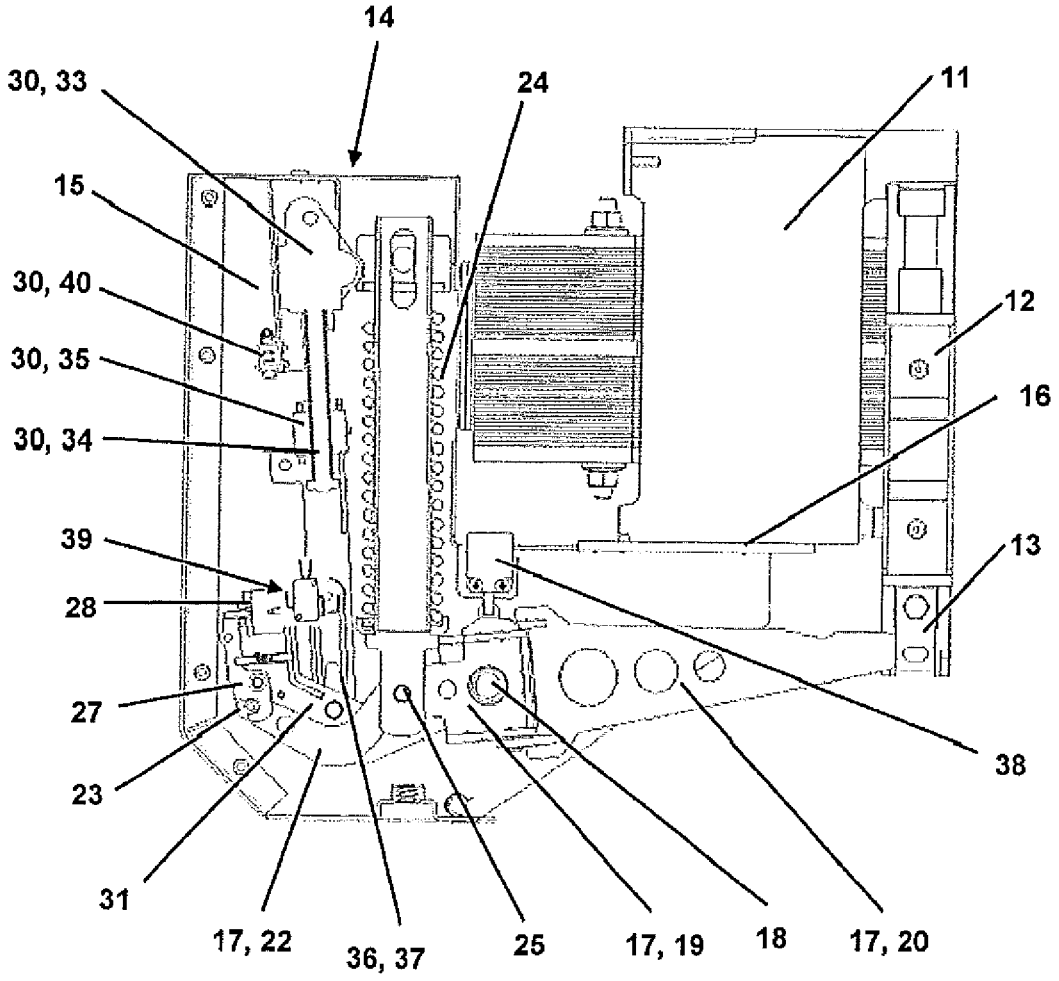
FIG. 9 shows the equipment with the safety brake device in reset position with closed retaining latch.

Resetting or release of the safety brake device is shown by way of example in FIGS. 7 to 9. The equipment 14 for actuating and resetting the safety brake device for that purpose comprises a return lever 31 on which the electromagnet 28 is arranged together with the retaining pawl 27 of the second position sensor 39. The return lever 31 is pivotably mounted on the pivot axle 18 so that a pivot radius of the retaining lug 23 of the control arm 22 and the retaining pawl 27 follow the same pivot path. The return lever 31 is connected with resetting equipment 30. In the example, the resetting equipment 30 comprises a spindle slide 35 which is connected with the return lever 31. The spindle slide 35 is moved back and forth by means of a spindle axle 34 by a spindle drive 33. Moreover, the resetting equipment 30 comprises a third position sensor 40, again preferably a microswitch, which ascertains a moved-in position of the spindle slide 35 and thus of the return lever 31.

Before resetting is now initiated, the travel body will usually have been moved back against the safety braking direction. The safety brake wedges 12 are thus released from the clamping position thereof and lie substantially loosely, or loaded merely by a force of the pressure store 24, against the guide rails.

After braking of the travel body has been carried out by the safety brake device 11 and correspondingly actuated equipment 14 for actuating and resetting the safety brake device, as is illustrated in FIG. 7, the spindle drive 33 now pivots—after initiation by the brake control 46 (FIG. 4)—the return lever 31 by way of the spindle axle 34 and the spindle slide 35 downwardly with respect to the control lever 22, so that the retaining pawl 27 moves relative to the retaining lug 23 as illustrated in FIG. 8. On reaching the retaining lug 23 the retaining lug 23 presses the retaining pawl 27 back against the switched-on electromagnet 28, which now in turn firmly holds the retaining pawl 27, as apparent in FIG. 9. This position is detected by the second position sensor 39. This is at the same time a control input to the brake control to reverse the movement direction of the spindle drive 33 and to move back the spindle slide 35, now together with the control arm, into the readiness position, correspondingly illustrated in FIG. 6. This readiness position is achieved as soon as the third position sensor 40 is actuated by the moved-back spindle slide 35, whereby resetting is concluded and the equipment 14 for actuating and resetting the safety brake device 14 is again in its readiness position, since simultaneously with the drawing back of the control arm 22 obviously also the pressure store 24 was stressed again. It is apparent that now during movement back of the equipment, in the case of faulty behavior of the travel body at any time, the safety brake device can be directly actuated again by switching off the electromagnet 28.

In addition, it is to be mentioned that instead of the spindle resetting obviously also other forms of drive, such as a linear motor or another pivot drive, can be used. A spindle drive is advantageous, since spindle drives of that kind are frequently used for, for example, actuation of vehicle windows and can be acquired correspondingly cheaply.

Further advantageous supplementary features are additionally apparent in FIGS. 6 to 9.

Thus, the spindle slide 35 in one embodiment is connected by way of a force limiter 36, for example a detent spring 37, with the return lever. Overloading of the resetting equipment 30 is thus precluded when the travel body is moved during the resetting movement itself, whereby an unexpected pressure force could act by way of the safety brake wedges 12 on the resetting equipment. The force limiter 36 limits the pressure force in the resetting equipment or in the spindle axle 34 to approximately 100 Newtons. If the maximum value is exceeded, then the clamping lever can displace in idle motion. In order to detent the clamping lever again the tension element is moved upwardly.

In addition, a shape of the retaining pawl 27 is selected in such a manner that the retaining pawl is opened again when, for example, the safety brake wedges 12 firmly clamped as before prevent drawing back of the same. In this case, the retaining pawl can be opened again by the force of the resetting equipment 30. Since at this point in time the second position sensor 39 is similarly opened, or actuated, again the brake control can recognize this state and start the resetting process again.

Figure 10:
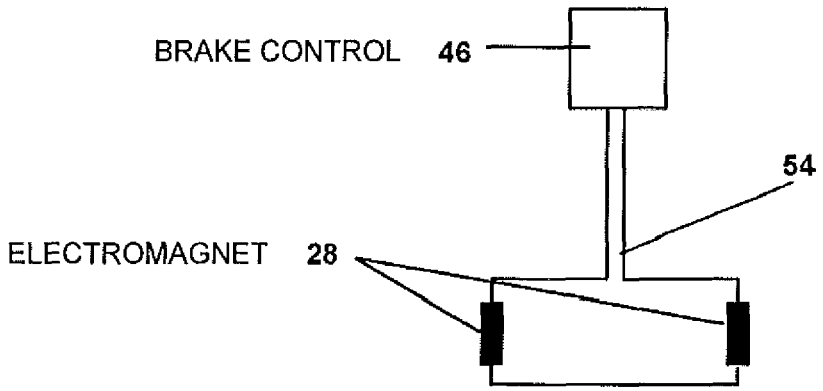
FIG. 10 shows a series connection of a pair of electromagnets of the equipment for actuating the safety brake device and FIG. 11 shows another configuration variant of an elevator installation with car and counterweight with integrated safety equipment.

FIG. 10 shows an advantageous connecting of the electromagnet 28 in the case of a typical use of two items of equipment for actuating and resetting a pair of safety brake devices. In this regard, as explained in FIGS. 1 to 4, respective equipment for actuating the safety brake device is connected with each safety brake device. The two electromagnets 28 are in that case connected in series and are acted on by way of the brake control 46 with a required retaining current. With this serial connection the two items of equipment for actuating and resetting the safety brake device are precisely electrically synchronized to milliseconds. The two safety brake devices to be actuated are thus triggered simultaneously.

At the same time, it is thereby also ensured that in the case of an electrical interruption in a coil of the electromagnets 28 the two safety brake devices trigger and a damaging safety braking at one side does not take place. A mechanical synchronization by a lever linkage is no longer necessary.

Figure 11:
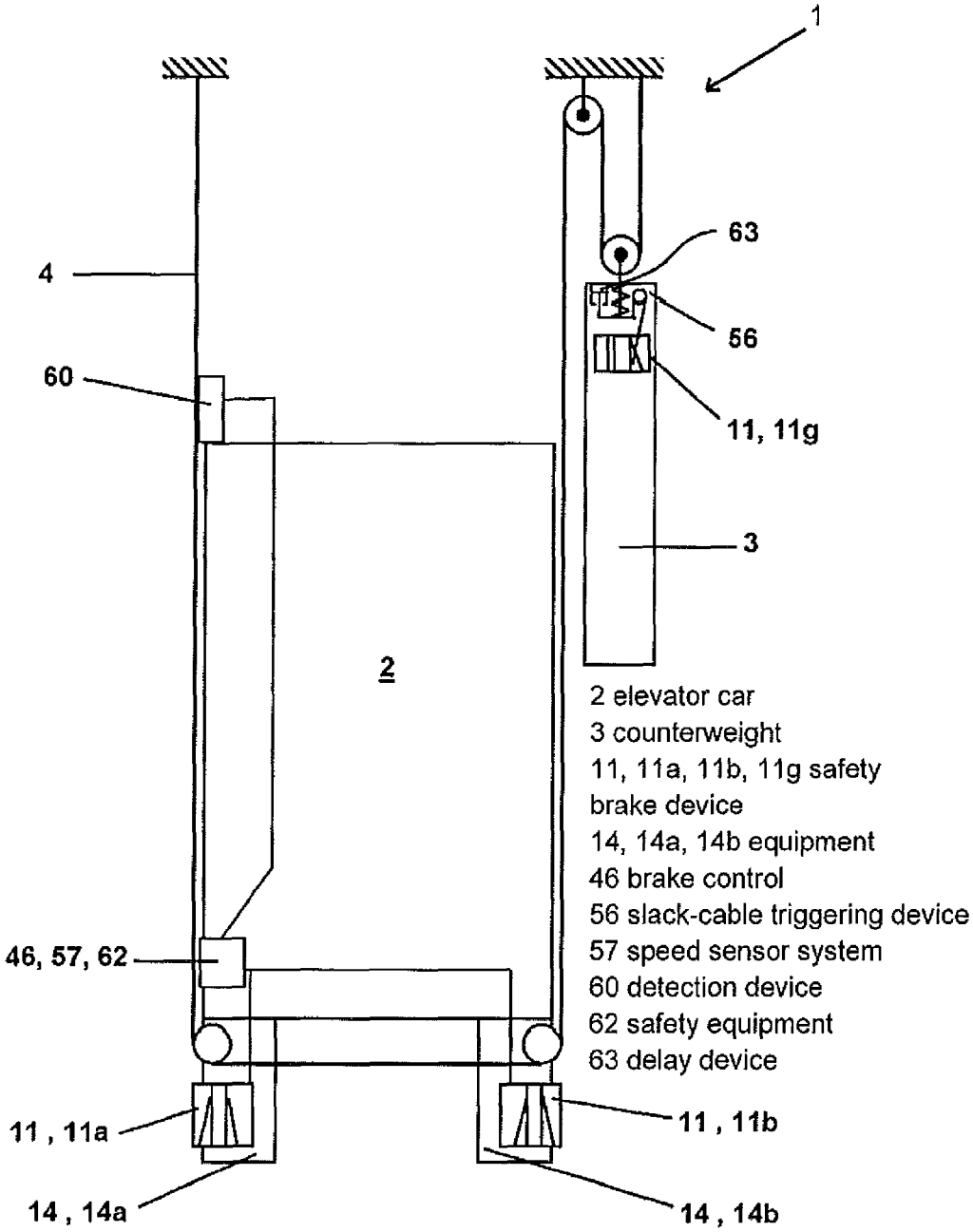

An embodiment, which is additional or alternative to FIGS. 1 to 3, of the safety concept of an elevator installation 1 is illustrated in FIG. 11. In that case, the elevator car 2 is equipped with safety brake devices 11, 11*a*, 11*b* and associated items of equipment 14, 14*a*, 14*b* for actuating the safety brake device with a brake control 46, as is described in the foregoing in connection with FIGS. 1 to 3. A corresponding speed sensor system 57 and/or a safety sensor system 62 optionally also belongs or belong thereto. In this embodiment the elevator car 2 further includes an optional detection device 60 for detecting an undesired movement away of the elevator car from standstill. In that case, a co-running wheel is when required pressed against a guide track of the elevator car. In normal operation the co-running wheel is spaced from the guide track, i.e. it is not driven. The detection device 60 includes a sensor which detects rotation of the co-running wheel, when it is pressed at standstill against the guide track, through a predetermined rotational angle and which on exceeding the predetermined rotational angle interrupts the equipment 14, 14*a*, 14*b* for actuating the safety brake device. The safety brake device 11, 11*a*, 11*b* is thereby actuated and further slipping away of the elevator car is prevented. A detection device 60 of that kind in the form of a monitoring device is disclosed in European Patent Application EP 10195788.4 of the same Applicant, which was filed on the same date.

The counterweight 3 is, by contrast thereto, equipped with a substantially known safety brake device 11*g*, which is actuated by a slack-cable triggering device or means 56. This means that the safety brake device 11*g* is actuated when a suspension force drops for a predetermined period of time below a preset value. If, for example, the support means in the elevator installation thus breaks, the safety brake device of the elevator car 2 would be actuated by way of the brake control 46 and the elevator car would be securely braked, and due to the now abruptly missing supporting force in the support means the slack-cable triggering means 56 would actuate the safety brake device 11*g* of the counterweight and secure the counterweight 3 against falling down. It is achieved by means of a delay device 63, such as, for example, by means of damping equipment, in the slack-cable triggering means 56 that triggering of the safety brake device 11*g* does not take place in the case of a transient oscillation.

With knowledge of the present invention the elevator expert can change the set shapes and arrangements as desired. For example, the brake control 46 and/or the energy module 43 and/or the speed sensors 57 can thus be constructed as separate subassemblies or these subassemblies can be combined in a safety packet. This safety packet can also be a component of an elevator control. The equipment for actuating as well as if need be resetting the safety brake devices can be attached as a subassembly to a safety brake device or it can also be assembled together with a safety brake device substantially in a single housing.

Moreover, it is obviously possible to use, instead of the safety brake device illustrated in FIGS. 5 to 9 with attached equipment for actuation and resetting of the safety brake device, a safety brake device with equipment for actuating the safety brake device according to the disclosure of European Patent Application EP 10195791.8 or another electrically actuable brake.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator installation having an elevator car and a counterweight each guided by at least two guide rails, the counterweight and the elevator car being connected together and supported by a support device, wherein the support device is guided over a deflecting roller or a drive pulley so that the counterweight and the elevator car move in opposite directions, comprising:

at least two first safety brake devices arranged at the elevator car and each associated with a respective one of the guide rails and which engage the guide rails by a respective safety brake element for selectively braking and fixing the elevator car at the guide rails;

an equipment arranged at the elevator car and connected to at least one of the first safety brake devices for actuation of the at least one first safety brake device;

at least one electronic safety device monitoring a safety state of the elevator installation and activating the equipment for actuation of the at least one first safety brake device;

at least two second safety brake devices arranged at the counterweight and each associated with a respective one of the guide rails and which engage the guide rails by a respective safety brake element for selectively braking and fixing the counterweight at the guide rails;

a slack-cable triggering device connecting the counterweight with the support device, wherein the second safety brake devices are actuated by the slack-cable triggering device when the support device is slack; and wherein the slack-cable triggering device includes a delay device which delays actuation of the at least one first safety brake device in response the support device becoming slack.

2. The elevator installation according to claim 1 wherein the delay device includes a path which is run through by the slack-cable triggering device before actuation of the at least one first safety brake device.

3. The elevator installation according to claim 1 wherein the delay device includes a damping device which delays actuation of the at least one first safety brake device.

4. The elevator installation according to claim 3 wherein the damping device is an oil damper.

5. The elevator installation according to claim 1 wherein the first safety brake devices act at opposite sides of the elevator car and brake in both upward and downward directions of travel of the elevator car.

6. An elevator installation having an elevator car and a counterweight each guided by at least two guide rails, the counterweight and the elevator car being connected together and supported by a support device guided over a deflecting roller or a drive pulley wherein the counterweight and the elevator car move in opposite directions, comprising:

at least two first safety brake devices are arranged at the elevator car and each associated with a respective one of the guide rails and which engage the guide rails by a respective safety brake element for selectively braking and fixing the elevator car at the guide rails;

a first equipment arranged at the elevator car being connected with at least one of the first safety brake devices for actuation thereof;

at least one first electronic safety device monitoring a safety state of the elevator installation and activating the first equipment for actuation of the at least one first safety brake device;

at least two second safety brake devices arranged at the counterweight and each associated with a respective one of the guide rails and which engage the guide rails by a respective safety brake element for selectively braking and fixing the counterweight at the guide rails;

a second equipment arranged at the counterweight and being connected with at least one of the second safety brake devices for actuation thereof;

a second electronic safety device controlling actuation and resetting of the at least one second safety brake device; and a compensating cable with integrated communications bus connected between the at least one first electronic safety device and the second electronic safety device.

7. The elevator installation according to claim 6 wherein the counterweight is supplied with electrical energy through the compensating cable.

8. The elevator installation according to claim 6 wherein status signals are communicated through the communications bus.

9. The elevator installation according to claim 6 wherein the communications bus is a power line connection.

10. The elevator installation according to claim 6 wherein the counterweight has an energy supply including a battery supplied with electrical power by a generator integrated in a guide wheel which guides the counterweight.

11. The elevator installation according to claim 6 wherein the counterweight has an energy supply including a battery supplied with electrical power by a contact bridge in a stopping position of the elevator car or of the counterweight.

12. The elevator installation according to claim 6 wherein the braking and fixing of the counterweight is controlled by the at least one first electronic safety device at the elevator car through signal lines integrated in the compensating cable.

* * * * *